US005814379A

United States Patent [19]

Roccaforte

[11] Patent Number: 5,814,379

[45] Date of Patent: Sep. 29, 1998

[54] ORNAMENTAL BAND

[76] Inventor: Arlene Roccaforte, 8 Moraine Rd., Morris Plains, N.J. 07950

[21] Appl. No.: 701,997

[22] Filed: Aug. 26, 1996

[51] Int. Cl.[6] ..... D04D 7/10

[52] U.S. Cl. ..... 428/5; 428/52; 428/99; 428/100

[58] Field of Search ..... 428/4, 5, 52, 99, 428/101, 100; 156/183

[56] References Cited

U.S. PATENT DOCUMENTS

| | | | |
|---|---|---|---|
| D. 287,099 | 12/1986 | Cory | D8/394 |
| 2,628,928 | 2/1953 | Cadous | 428/493 X |
| 2,728,165 | 12/1955 | Runyon | 428/52 X |
| 2,784,811 | 2/1957 | Dilar et al. | 428/52 X |
| 3,370,779 | 2/1968 | Cole | 428/4 X |
| 3,461,584 | 8/1969 | Wilson | 40/591 |
| 4,862,554 | 9/1989 | Chojnacki | 49/460 X |
| 5,123,223 | 6/1992 | Makarevich et al. | 428/10 X |
| 5,177,986 | 6/1993 | Jensen | 70/18 |
| 5,351,733 | 10/1994 | Ullman | 150/154 |
| 5,392,983 | 2/1995 | Clarke-lBolling et al. | 428/4 X |
| 5,456,062 | 10/1995 | Wechsler | 428/4 X |
| 5,525,176 | 6/1996 | Higa | 156/183 |
| 5,614,274 | 3/1997 | Huss | 428/5 |

*Primary Examiner*—Harry F. Epstein
*Attorney, Agent, or Firm*—Robert L. Epstein, Esq.; Harold James, Esq.; James & Franklin, LLP.

[57] ABSTRACT

A strip of elastic is stretched over and encircles an object such as a door, car trunk or book cover. A tubular fabric cover may surround the strip. The cover is bunched so as to be capable of expanding lengthwise as the strip is stretched. A bow or other decoration, preferrably coordinated in appearance with the cover fabric, is removeably affixed to the band. One or more loops are formed in the band, preferrably proximate the bow, for hanging or mounting articles. The band may be continuous or may have a buckle to connect the ends.

11 Claims, 3 Drawing Sheets

FIG. 1
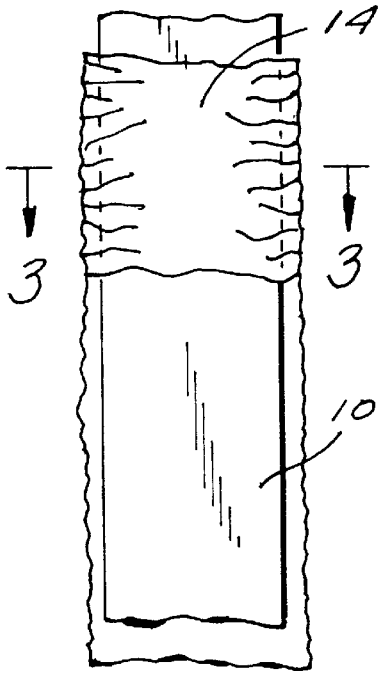
FIG. 2
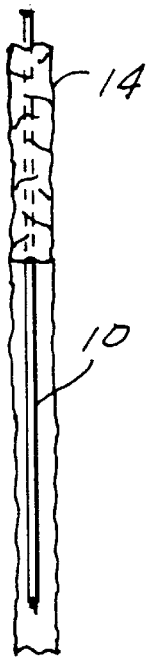
FIG. 3
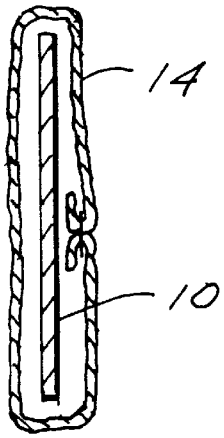
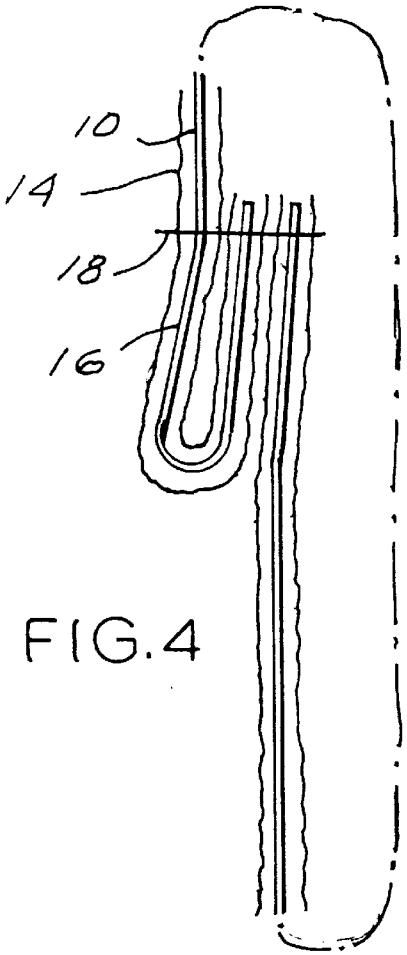
FIG. 4
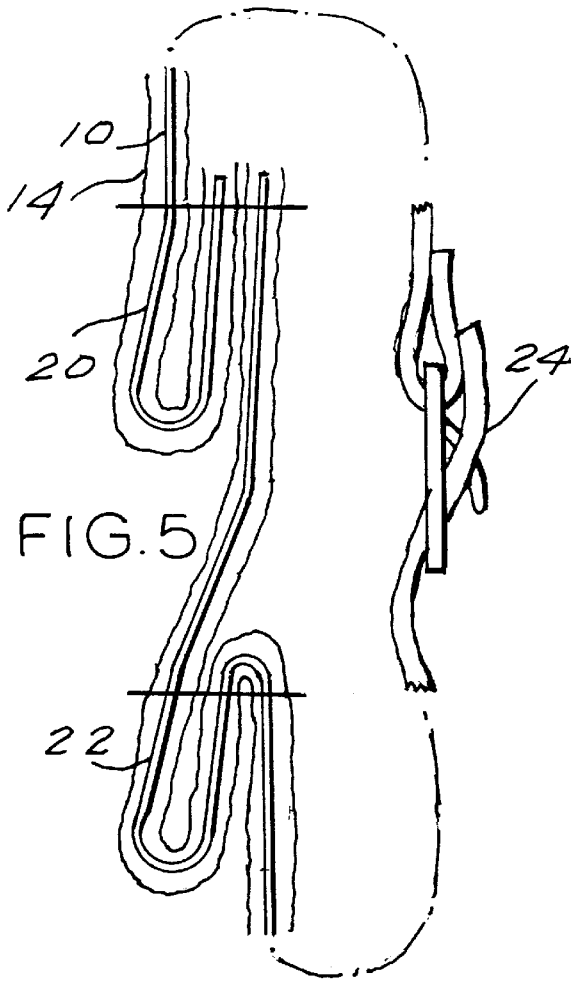
FIG. 5

FIG. 10
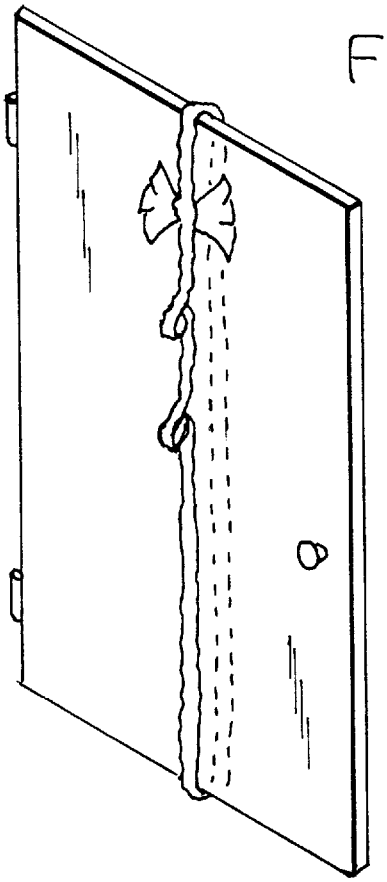
FIG. 11
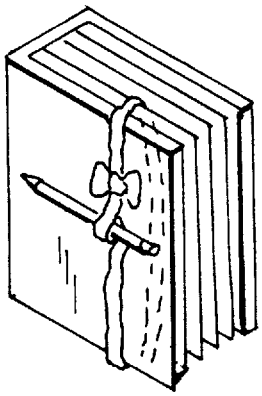
FIG. 12
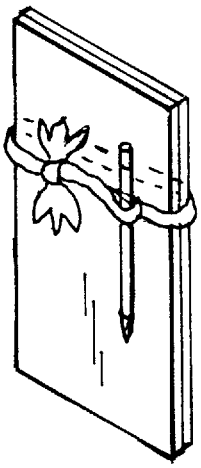
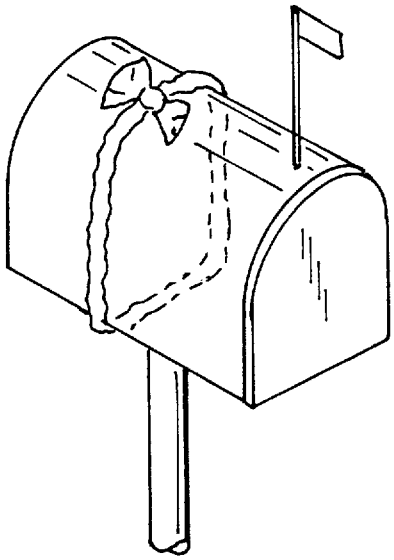
FIG. 13

ORNAMENTAL BAND

The present invention relates to an ornamental item for decorating objects and more particularly to an ornamental band adapted to decorate a variety of different objects which can be mounted on the object without damaging the surface thereof and from which articles may be hung or removeably affixed.

Bows and other decorative elements are often used to temporarily adorn various objects such as front doors, automobile trunks, book covers, mail boxes, writing pads and the like. Such elements may be utilized to indicate certain occasions, such as birthdays or weddings or to celebrate holidays, such as Christmas.

However, there is no easy way to mount such decorative elements to the object without damaging the surface of the object. Mechanical fasteners which may create holes in the object. Adhesives which may mar the surface finish or leave a residue. Moreover, there is no facility for hanging or mounting articles from the element. Hence, there is a need for a means for mounting decorative elements without damaging the surface of the object upon which same are situated and for providing a facility to hang or mount articles thereto.

To fill this need, I have invented a simple ornamental band which can be used to decorate a wide variety of different objects. Because my band encircles the object and is held in place by friction, it is easy and quick to install and remove. It requires no special installation tools or skill. It will not damage the surface of the object. It can be used repeatedly. Moreover, it is mechanically simple, very versatile and can be manufactured using conventional equipment.

In general, these objects are achieved through the use of a strip of elastic material large enough to be stretched over and frictionally retained on the object to be ornamented. A decorative fabric cover may surround the strip. An appearance coordinated bow or other decorative element is removeably affixed to the band. Preferrably, provision is made for hanging or mounting one or more articles from the band.

More particularly, in accordance with one aspect of the present invention, an ornamental band is provided for encircling an object. The band includes a strip of elastic material large enough to be stretched over and retained on the object. A tubular cover surrounds the strip. The cover is formed of substantially non-stretchable material which is bunched together so as to have an effective length which is expandable as the strip is stretched. A decorative element is affixed to the band.

Means are provided for hanging an article from the band. The hanging means may be one or more loops spaced along the band.

The decorative element may comprise a bow. Preferrably, the bow is appearance coordinated with the cover fabric.

The band may be adapted to be mounted over any object. It is especially useful for mounting decorative elements on a door. It may also be mounted over a book cover, writing pad or even a mail box.

The band may be a continuous strip. Alternatively, the strip may have first and second ends and a buckle for attaching the ends.

In accordance with another object of the present invention, an ornamental band is provided for encircling an object. The band includes a strip of elastic material large enough to be stretched over and retained on the object. A decorative element is mounted on the band. Loop means are affixed to the band.

The decorative element comprises a bow. The loop means may include a single loop or several loops spaced along the band. The strip may be continuous or have first and second ends with a buckle for connecting the ends. Means for removeably mounting the decorative element on the band may be provided.

In accordance with a third aspect of the present invention, an ornamental band is provided for encircling an object. The band includes a strip of elastic material formed into a first portion for encircling the object. The first portion is large enough to be stretched over and retained on the object. The band has a second section situated in side by side relation to the first portion. The second section is affixed to the first portion at spaced intervals so as to form a first compartment.

A second compartment may be formed as well. The strip may have a bunched fabric cover.

BRIEF DESCRIPTION OF THE DRAWINGS

To these and such other objects which may hereinafter appear, the present invention relates to an ornamental band as described in detail in the following specification, recited in the annexed claims and illustrated in the accompanying drawings, in which like numerals refer to like parts, and in which:

FIG. 1 is a front partially cut away view of a portion of the band of the present invention;

FIG. 2 is a side partially cut away view of a portion of the band;

FIG. 3 is a cross-sectional view taken along line 3—3 of FIG. 1.

FIG. 4 is a side elevational view of a section of the band with a single loop;

FIG. 5 is a side elevational view of a section of the buckle version of the band with two loops.

FIG. 10 is an isometric view of the band mounted on a door;

FIG. 11 is an isometric view of the band mounted on a book cover;

FIG. 12 is an isometric view of the band mounted on a writing pad; and

FIG. 13 is an isometric view of the band mounted on a mail box.

As illustrated in FIGS. 1–7, the first preferred embodiment of the band of the present invention includes a strip of elastic material 10 which can be continuous, as seen in FIG. 4, or have ends connectable with a buckle or the like, as illustrated in FIG. 5. The length and width of the band are selected in accordance with the intended purpose. Thus, a band designed for use on the front door of a house, as illustrated in FIG. 10, for example, would be selected to be long enough to be stretchable to encircle and frictionally engage the door lengthwise and wide enough to carry a relatively large decorative element such as a bow 12, fabric flower or the like. On the other hand, a band designed for use as a book marker, as seen in FIG. 11, or to decorate a writing pad, as illustrated in FIG. 12, would be much shorter and narrower and would be designed to carry a much smaller decorative element.

Figure 6:
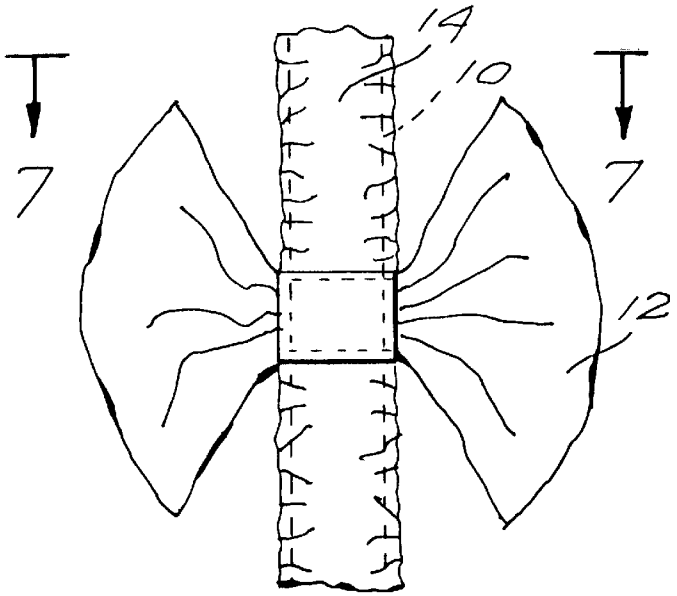
FIG. 6 is a front plain view of a section of the band with a decorative bow.

A tubular fabric cover 14 may be used to surround the strip. Cover is formed of a length of non-stretchable fabric material. The edges of the fabric material are sewn together to form a tube within which is situated the elastic strip 10, as is best seen in FIG. 3. When used to form a continuous band, the ends are sewn together. If a buckle is used, the ends of the tube terminate at the ends of the strip.

Cover 14 is bunched together so that although it is substantially longer than strip 10, in the bunched condition, the strip will fit inside. Because of this, the effective length of the cover is expandable as the elastic strip is stretched. This permits the band to be easily mounted on any object of the appropriate size, without damaging the surface of the object.

As shown in FIG. 4, the band may be continuous and include a loop 16 fabricated by forming a small portion of the strip 10 into a circle and using stitches 18 along the base of the circle to form a permanent loop. The loop could be used to hang or mount other articles, such as a wreath at Christmas or a cardboard pumpkin at Halloween, if the band is used on a door. In a smaller version, such as illustrated in FIGS. 11 and 12, a pen or pencil can be retained in the loop.

FIG. 5 shows the band with first and second spaced loops 20, 22. It also shows the band with first and second ends connected by a buckle 24. However, other fastening means, such as hook and loop strip fastener could be used.

Figure 7:
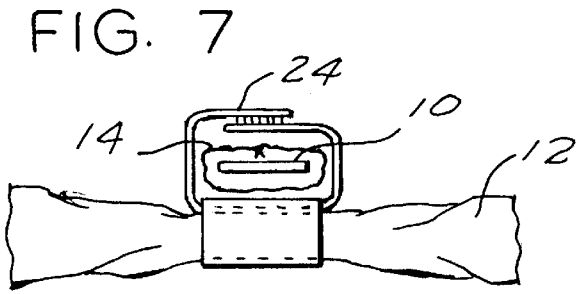
FIG. 7 is a cross-sectional view taken along line 7—7 of FIG. 6.

FIG. 6 illustrates a bow 12 mounted on the band. Other decorative elements such as fabric flowers, ribbons on the like can be used as well. The bow can be sewn to the band, but more preferrably it is affixed to a strip of hook and loop fastener 24 adapted to encircle the band, as illustrated in FIG. 7, so it can be easily removed. This permits decorative elements to be interchanged as desired. Preferrably, the bows are appearance coordinated with the cover 14.

Figure 8:
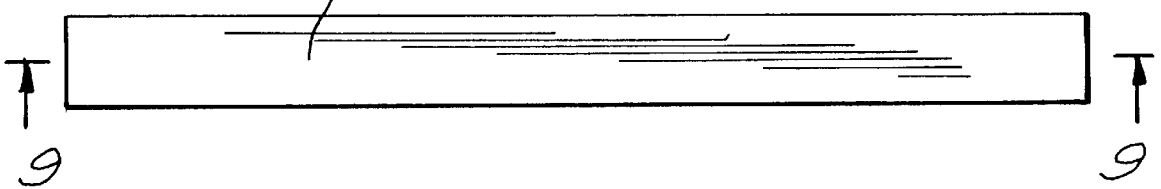
FIG. 8 is a front elevational view of a second preferred embodiment of the invention.
Figure 9:
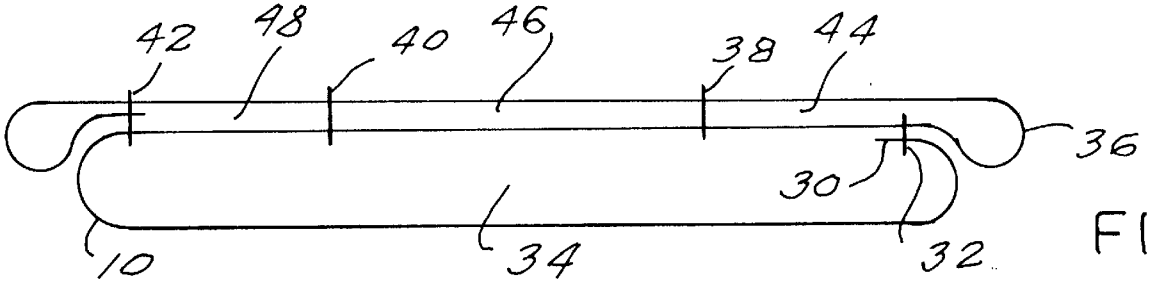
FIG. 9 is a side view of the band of FIG. 8.

In a second preferred embodiment, as illustrated in FIGS. 8 and 9, the elastic strip 10 may have a first end 30 stitched at 32 to form an object encircling part 34. The strip is then bent back over itself at 36 and stitched at 38, 40 and 42 to form three compartments 44, 46 and 48. Each of the compartments can be used to retain an article or mount one or more decorative elements. The second embodiment can be provided with a bunched fabric cover or not, as desired.

It should now be appreciated that the present invention relates to a simple, inexpensive and versatile ornamental band which consists of an elastic strip adapted to encircle an object and to carry a decorative element such as a bow or the like. A bunched fabric cover can be used to enhance the appearance of the band. Loops or compartments can be used for hanging or mounting articles. The band will not damage the surface of the object. It is easy to install, requiring no special tools or skills. It is inexpensive to manufacture, requiring no specialized equipment.

While only a limited number of preferred embodiments have been disclosed for purposes of illustration, it is obvious that many variations and modifications could be made thereto. It is intended to cover all of these variations and modifications which fall within the scope of the invention, as recited in the following claims.

I claim:

1. An ornamental band for encircling an object comprising a strip of elastic material large enough to be stretched over and retained on the object, a tubular cover surrounding and enclosing said strip along substantially the entire length of said strip, said cover formed of substantially non-stretchable material bunched so as to have an effective length which is expandable as said strip is stretched and means for retaining an article on said band.

2. The band of claim 1 wherein said retaining means comprises a loop.

3. The band of claim 1 wherein said retaining means comprises first and second loops.

4. The band of claim 1 further comprising decorative means affixed to said band.

5. The band of claim 4 further comprising means for removably mounting said decorative means on said band.

6. The band of claim 4 wherein said decorative means is appearance coordinated with said non-stretchable material.

7. The band of claim 4 wherein said decorative means comprises a bow.

8. The band of claim 1 adapted to be mounted over a door.

9. The band of claim 1 adapted to be mounted over a book cover.

10. The band of claim 1 wherein said strip is continuous.

11. The band of claim 7 wherein said strip has first and second ends and a buckle for attaching said ends.

* * * * *